US005352007A

United States Patent [19]

Kirsch

[11] Patent Number: 5,352,007

[45] Date of Patent: Oct. 4, 1994

[54] CONFORMAL ARTICLE CARRIER

[75] Inventor: Jerome Kirsch, Dix Hills, N.Y.

[73] Assignee: K-5 Industries Inc., Dix Hills, N.Y.

[21] Appl. No.: 904,465

[22] Filed: Jun. 25, 1992

[51] Int. Cl.[5] ..... A45F 5/10

[52] U.S. Cl. ..... 294/149; 294/138

[58] Field of Search ..... 294/137, 138, 141–143, 294/146, 147, 149, 150, 152–157, 159, 165, 167; 150/154; 190/102, 103, 115, 117, 119, 124, 902; 206/284, 410, 424, 472, 491, 494; 229/87.01, 87.04

[56] References Cited

U.S. PATENT DOCUMENTS

| | | | |
|---|---|---|---|
| 741,400 | 10/1903 | Harrington | 294/138 |
| 784,972 | 3/1905 | Barton | 294/138 |
| 954,840 | 4/1910 | Wiedemann | 294/150 X |
| 2,273,302 | 2/1942 | Vineberg | 206/284 X |
| 2,319,729 | 5/1943 | Ford | 190/102 |
| 3,942,636 | 3/1976 | Matsuyama et al. | 294/156 X |
| 4,210,244 | 7/1980 | Westrick | 294/153 X |
| 4,553,779 | 11/1985 | Shortridge | 294/152 X |
| 4,682,691 | 7/1987 | Spiering | 294/149 X |
| 4,712,820 | 12/1987 | Cartledge | 294/138 |
| 4,881,684 | 11/1989 | Chinman | 294/150 X |
| 4,911,271 | 3/1990 | Stanley | 294/149 X |

*Primary Examiner*—Johnny D. Cherry
*Attorney, Agent, or Firm*—Daniel Jay Tick

[57] ABSTRACT

A sheet of flexible material has a pair of spaced opposite faces, first and second spaced opposite side edges and third and fourth spaced opposite side edges. The side edges border the opposite faces. A slit is formed through the sheet in proximity with the first edge for removably supporting the sheet on a supporting object. Fastening devices on one of the faces of the sheet adjacent the first edge and each of the third and fourth edges and on the other of the faces of the sheet adjacent the second edge and each of the third and fourth edges function to fasten the sheet to itself with an article rolled up therein and with the second edge in proximity with the first edge. The sheet thus supports and carries the article so that the article is removably supported and carried by the supporting object via the sheet.

1 Claim, 5 Drawing Sheets

CONFORMAL ARTICLE CARRIER

BACKGROUND OF THE INVENTION

The present invention relates to an article carrier or carrying device. More particularly, the invention relates to an article carrier or carrying device for articles or objects such as, for example, umbrellas, rolled newspapers, tennis rackets, baseball bats, cans of tennis balls, flashlights, fire extinguishers, water bottles, thermos containers, soda cans, golf clubs, or the like.

A person carrying an attache case, a briefcase, luggage, a lunch pail, or the like, or anything held by a handle or handles is inconvenienced when he or she wishes to take an umbrella along for immediate or anticipated near future use. In such case, the person may not take the umbrella, although precipitation is expected weatherwise, due to various inconveniences which include the fact that the umbrella may not fit in the attache case, or the like, or may not fit readily or without difficulty, or may bulge when placed in such case, or the like. Furthermore, if the umbrella is wet or damp, it would most likely wet the contents of the case, or the like. Also, it would be quite awkward and undignified to permit the umbrella to hang or dangle from the case, or the like. In addition, such person would feel awkward and rather helpless if he or she were to hold the case, or the like, in one hand and the umbrella in the other hand, as when greeting people or unlocking doors. Furthermore, such person may enjoy reading a newspaper on the way to his destination, or once he has arrived. A newspaper will most often not fit in the case, luggage, pail, or the like, and will blacken the reader's fingers and hands.

The principal object of the invention is to provide a carrying device for carrying and supporting an umbrella, newspaper, or other article or object, or objects via a handle or handles of an attache case, briefcase, luggage,lunch pail, or the like, or anything held by a handle or handles.

An object of the invention is to provide a carrying device for carrying and supporting an umbrella, or any suitable object, or objects, via any suitable supporting object such as, for example, a handle or handles of an attache case, briefcase, luggage, or the like.

Another object of the invention is to provide a carrying device for carrying and supporting an umbrella, or other object, or objects, via a handle or handles of an attache case, briefcase, luggage, or the like, outside said case, or the like, so that there are no annoyances of non-fitting, poor fitting, bulging of said case, or the like, or wetting of the contents of said case.

Still another object of the invention is to provide a carrying device for carrying and supporting an umbrella, or other object, or objects, or the like, via a handle or handles of an attache case, briefcase, luggage, or the like, outside said case, in a manner whereby said umbrella, or the like, is carried and supported with dignity and without awkwardness.

Yet another object of the invention is to provide a carrying device of simple structure, which is inexpensive in manufacture, used with facility and convenience and functions efficiently, effectively and reliably to carry and support an umbrella, or other object, or objects, or the like, via a handle or handles of an attache case, briefcase, luggage, or the like, without dangling.

Another object of the invention is to provide a carrying device for carrying and supporting any suitable object, or objects, via any suitable supporting object such as, for example, a handle, or handles, of an attache case, briefcase, or any type of manual carrier device, or the like, without interference with the case, or the like, or with the holder or user of the case, or the like.

Still another object of the invention is to provide a carrying device for carrying and supporting any suitable object, or objects, via any suitable supporting object such as, for example, a wide variety of handles of different dimensions, lengths and widths of attache cases, briefcases, or any type of manual carder devices, or the like, without sagging of the, carrying device and with acceptable rigidity.

Yet another object of the invention is to provide a carrying device for carrying and supporting any suitable object, or objects, via any suitable supporting object such as, for example, a handle, or handles, of an attache case, briefcase, or any type of manual carrier device, or the like, which carrying device conforms in shape to any object it carries and is adjustable and adaptable to so conform, with facility and convenience.

Another object of the invention is to provide a carrying device for carrying and supporting any suitable object, or objects, via any suitable supporting object such as, for example, a handle, or handles, of an attache case, briefcase, or any type of manual carrier device, or the like, without dangling, looseness, or slippage, thereby securing the integrity of delicate, breakable and heavy objects carried by the carrying device.

BRIEF SUMMARY OF THE INVENTION

In accordance with the invention, a carrying device for an article or object comprises a sheet of substantially flexible material having a pair of spaced opposite faces, first and second spaced side edges and third and fourth spaced side edges. The side edges border the opposite faces. A support device is in the sheet in proximity with the first edge for removably supporting the sheet on a supporting object. Fasteners are on the sheet for fastening the sheet to itself with an article rolled up therein and with the second edge in proximity with the first edge, whereby the sheet supports and carries the article so that the article is removably supported and carried by the supporting object via the sheet.

The support device comprises a slit formed through the sheet.

The fasteners comprise pressure fastening material on both faces of the sheet.

The fasteners on one of the faces of the sheet are adjacent the first edge and each of the third and fourth edges. The fasteners on the other of the faces of the sheet are adjacent the second edge and each of the third and fourth edges. The fasteners fasten the sheet to itself with an article rolled up therein and with the second edge in proximity with the first edge whereby the sheet supports and carries the article so that the article is removably supported and carried by the supporting object via the sheet.

The fasteners comprise the first strip of pressure fastening material on one of the faces of the sheet extending along the third edge from the first edge, a second strip of pressure fastening material on the one of the faces of the sheet extending along the fourth edge from the first edge, a third strip of pressure fastening material on the other of the faces of the sheet extending along the third edge from the second edge and a fourth strip of pressure fastening material on the other of the faces of the sheet extending along the fourth edge from the second edge. The first and third strips are releasably affixed to each other when the article is rolled up in the sheet and at least part of the first and third strips overlap and are pressed together. The second and fourth strips are releasably affixed to each other when the article is rolled up in the sheet and at least part of the second and fourth strips overlap and are pressed together.

The first and second edges are in spaced substantially parallel relation with each other and the third and fourth edges are in spaced substantially parallel relation with each other and substantially perpendicular to the first and second edges.

The first and third strips of pressure fastening material are spaced from each other, the second and fourth strips of pressure fastening material are spaced from each other, the first and second strips of pressure fastening material are spaced from each other and the third and fourth strips of pressure fastening material are spaced from each other.

Tear preventing means is provided at the ends of the slit.

The material may comprise plastic, vinyl, canvas, leather, or other.

In accordance with the invention, a carrying device for an article comprises a sheet of substantially flexible material having a pair of spaced opposite faces, first and second spaced opposite side edges and third and fourth spaced opposite side edges, the side edges bordering the opposite faces. Slit means is formed through the sheet in proximity with the first edge for removably supporting the sheet on a supporting object. Fasteners are on one of the faces of the sheet adjacent the first edge and each of the third and fourth edges. Fasteners are on the other of the faces of the sheet adjacent the second edge and each of the third and fourth edge. The fasteners fasten the sheet to itself with an article rolled up therein and with the second edge in proximity with the first edge whereby the sheet supports and carries the article so that the object is removably supported and carried by the supporting object via the sheet.

The fasteners comprise a first strip of pressure fastening material on one of the faces of the sheet extending along the third edge from the first edge, a second strip of pressure fastening material on the one of the faces of the sheet extending along the fourth edge from the first edge, a third strip of pressure fastening material on the other of the faces of the sheet extending along the third edge from the second edge and a fourth strip of pressure fastening material on the other of the faces of the sheet extending along the fourth edge from the second edge. The first and third strips are releasably affixed to each other when the article is rolled up in the street and at least part of the first and third strips overlap and are pressed together and the second and fourth strips are releasably affixed to each other when the article is rolled up in the sheet and at least part of the second and fourth strips overlap and are pressed together.

The first and second edges are in spaced substantially parallel relation with each other and the third and fourth edges are in spaced substantially parallel relation with each other and substantially perpendicular to the first and second edges.

The first and third strips of pressure fastening material are spaced from each other, the second and fourth strips of pressure fastening material are spaced from each other, the first and second strips of pressure fastening material are spaced from each other and the third and fourth strips of pressure fastening material are spaced from each other.

In another embodiment of the invention, a first slit is formed in the sheet through the first strip of pressure fastening material spaced from and substantially parallel to the third edge and a second slit is formed in the sheet through the second strip of pressure fastening material spaced from and substantially parallel to the fourth edge.

Tear preventing means is provided at the ends of the slit.

Perforations may be formed through at least part of the sheet.

In accordance with the invention, a method of carrying an article comprises the steps of placing an article on one face of a sheet of substantially flexible material having a pair of spaced opposite faces, first and second spaced side edges and third and fourth spaced side edges extending substantially transverse to the first and second edges, the sides bordering the opposite surfaces. A slit is formed through the sheet in proximity with the first edge for removably supporting the sheet on a supporting object. Fasteners are provided on both faces of the sheet. The article is rolled up in the sheet with the second edge in proximity with the first edge. The sheet is fastened to itself in proximity with the first and second edges whereby the sheet supports and carries the article so that the article is removably supported and carried by the supporting object via the sheet.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENT

The carrying device of the invention is for any article or object, or articles or objects, 1 (FIGS. 3 to 6) such as, for example, an umbrella, a newspaper, a T-square, a telephone, storage or shipping cylinders, golf clubs, a tennis racket, a baseball bat, a can of tennis balls, a flashlight, a fire extinguisher, a water bottle, a thermos container, a telescope, a bottle of wine, a radio transceiver, fishing pole sections, tools, or the like. The device of the invention comprises a sheet 2A of substantially flexible material such as, for example, plastic or, more specifically, vinyl (FIGS. 1 to 6), canvas, leather, or the like. The sheet 2A may also consist of elastic material, or may partially consist of elastic material, of any suitable known type. The sheet 2A may, of course, be of any desired color scheme.

Figure 1:
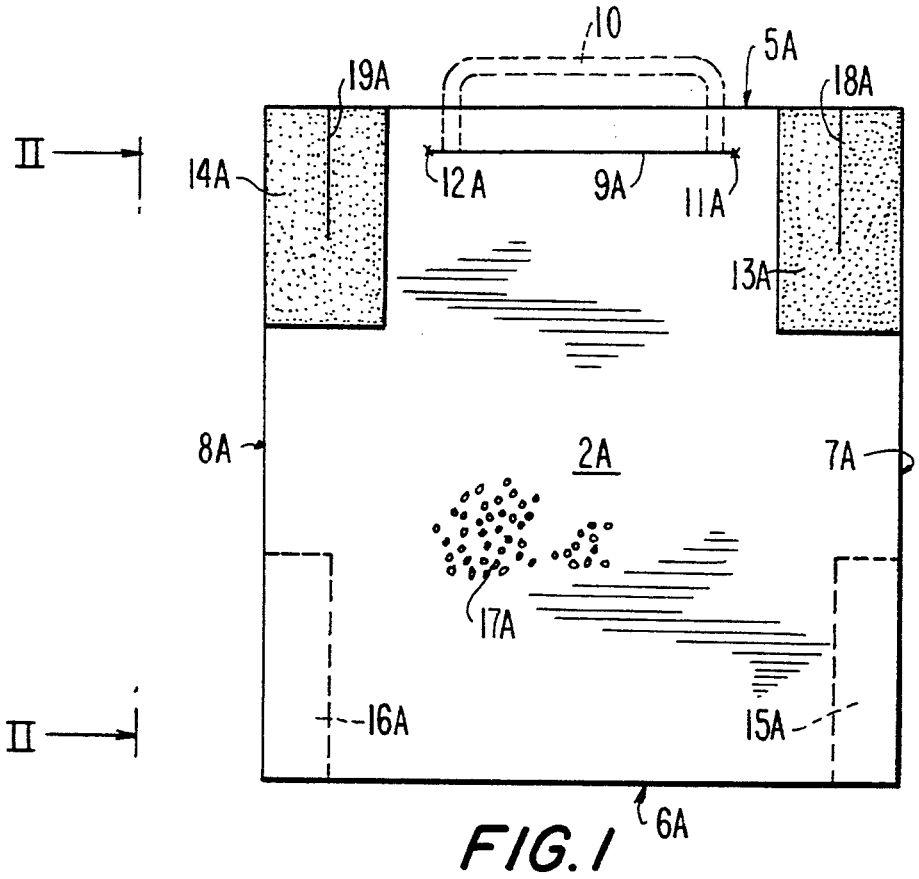
FIG. 1 is a top plan of a first embodiment of the carrying device of the invention.
Figure 2:
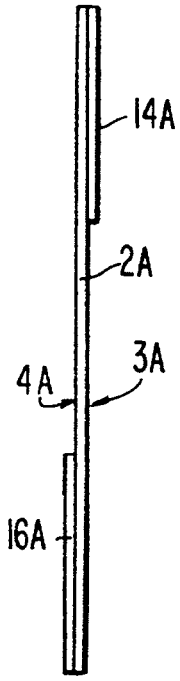
FIG. 2 is a side view, taken along the lines II—II, of FIG. 1.
Figure 3:
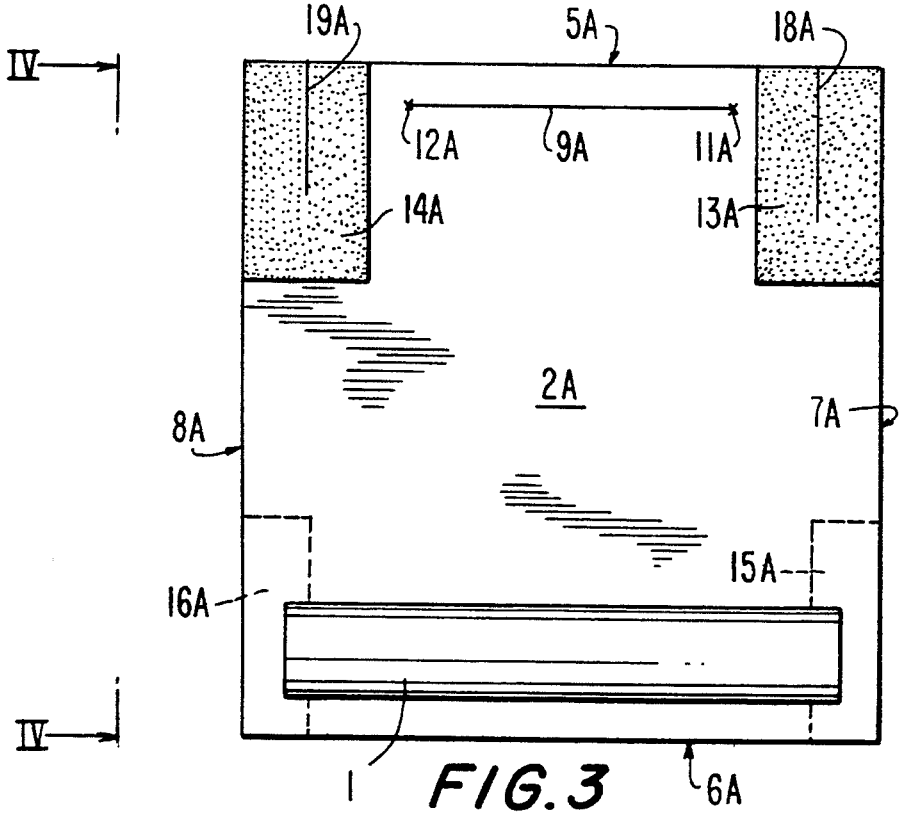
FIG. 3 is a top plan of the embodiment of FIG. 1 ready for preparing it to carry and support an article.

The sheet 2A has a pair of spaced opposite faces or surfaces 3A and 4A (FIGS. 2 and 4), first and second spaced opposite side edges 5A and 6A, respectively, (FIGS. 1 and 3) and third and fourth spaced opposite side edges 7A and 8A, respectively, (FIGS. 1 and 3). The sheet 2A may be of any suitable geometrical configuration although in the preferred embodiment, shown in FIGS. 1 and 3, it is a rectangle.

The side edges 5A, 6A, 7A and 8A border the opposite faces 3A and 4A of the sheet 2A. In the illustrated preferred embodiments the first and second edges 5A and 6A, respectively, are in spaced substantially parallel relation with each other. The third and fourth edges 7A and 8A, respectively, are in spaced substantially parallel relation with each other and are substantially perpendicular to the first and second edges 5A and 6A, respectively.

A slit, or slot, 9A, or the like, (FIGS. 1 and 3) is formed through the sheet 2A in proximity with the first edge 5A and preferably substantially parallel to said first edge, as shown in FIGS. 1 and 3. The slit 9A removably supports the sheet 2A on a supporting object such as, for example, a handle, or handles, 10 of an attache case, briefcase, luggage, lunch pail, or any manual carrying case, bag, or the like, which handle or handles passes through said slit, as shown in FIG. 1. The slit, or slot, 9A, or the like, may be of any desired length so that it may accommodate any size handle, or handles, 10. The slit 9A may have scored, or perforated, extensions at one, or both, ends to enable a user to extend the length of said slit, as desired. Alternatively, precut holes may be provided colinearly with the slit 9A, so that a user may cut the material to lengthen said slit, to enable the carrying device of the invention to be mounted on a handle, or handles, 10 of greater than usual length and/or width. Tear preventing means of any suitable known type such as, for example, reinforced areas, (FIGS. 1 and 3) are provided at the ends 11A and 12A of the slit.

Fasteners 13A and 14A are provided on one face 3A of the sheet 2A adjacent the first edge 5A and each of the third and fourth edges 7A and 8A, respectively, as shown in FIG. 1 by solid lines. Fasteners 15A and 16A are provided on the other face 4A of the sheet 2A adjacent the second edge 6A and each of the third and fourth edges 7A and 8A, respectively, as shown in FIG. 3 by broken lines. The fasteners 13A, 14A, 15A and 16A function to fasten the sheet 2A to itself with the object 1 (FIGS. 3 to 6) rolled up therein and with the second edge 6A in proximity with the first edge 5A, as shown in FIG. 6, whereby said sheet supports and carries said object, so that said object is removably supported and carried by the handle, or supporting object, 10.

The first strip 13A of pressure fastening material such as, for example, VELCRO TM, on the face 3A of the sheet 2A extends along the third edge 7A from the first edge 5A. The second strip 14A of pressure fastening material such as, for example, VELCRO TM, on the face 3A of the sheet 2A extends along the fourth edge 8A from the first edge 5A. The third strip 15A of pressure fastening material such as, for example, VELCRO TM, on the face 4A of the sheet 2A extends along the third edge 7A from the second edge 6A. The fourth strip 16A of pressure fastening material such as, or example, VELCRO TM, on the face 4A of the sheet 2A extends along the fourth edge 8A from the second edge 6A.

The first and third strips of pressure fastening material 13A and 15A, respectively, are spaced from each other. The second and fourth strips of pressure fastening material 14A and 16A, respectively, are spaced from each other. The first and second strips of pressure fastening material 13A and 14A, respectively, are spaced from each other. The third and fourth strips of pressure fastening material 15A and 16A, respectively, are spaced from each other.

Figure 6:
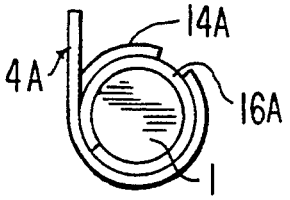
FIG. 6 is the view of FIG. 4, showing a final stage in which the article to be carried and supported is completely rolled up in the sheet of the carrying device of the invention.

When the umbrella, or other object 1, is rolled up in the sheet 2A, as shown in FIG. 6, the first and third strips of pressure fastening material 13A and 15A overlap at least partially and the second and fourth strips of pressure fastening material 14A and 16A overlap at least partially. When the overlapping portions of the first and third strips 13A and 15A are manually pressed together, said first and third strips become releasably affixed to each other and when the overlapping portions of the second and fourth strips 14A and 16A are manually pressed together, said second and fourth strips become releasably affixed to each other.

The carrying device of the invention provides convenient, elegant and efficient support and carrying of an umbrella, or other object 1, before and after use. Thus, perforations 17A may be formed through at least part of the sheet 2A, as shown in FIG. 1, so that a wet umbrella 1 may be carried and supported after use and may drain and/or water may evaporate from said umbrella via said perforations.

An operating model of the carrying device of the invention was 9.5 inches long on its third and fourth sides 7A and 8A and 13.5 inches long on its first and second sides 5A and 6A. The tear preventing means at the ends 11A and 12A of the slit 9A may comprise punched holes to relieve stress, or additional material of greater tear resistance than that of the sheet 2A bonded to said sheet over the areas at said ends of said slit, If the material of the sheet 2A has high tear resistance, no tear preventing means is required. In the operating model, the first and second strips of pressure fastening material 13 A and 13B and 14A and 14B were VELCRO TM 1 inch wide and 3 inches long in the first embodiment (FIGS. 1 to 6) and VELCRO TM ¾ inch wide and 4½ inches long in the second embodiment (FIG. 7) and the third and fourth strips of pressure fastening material 15A and 15B and 16A and 16B were VELCRO TM, ¾ inch wide and 5.5 inches long in the first and second embodiments of the invention. The sheet 2A, 2B was 1/16 inch thick.

The fasteners 13A, 14A, 15A, 16A and 13B, 14B, 15B, 16B may be other than the pressure fastened VELCRO TM. They may consist of any suitable fasteners such as, for example, hooks and eyes or loops, snaps, magnets, or the like.

Figure 4:
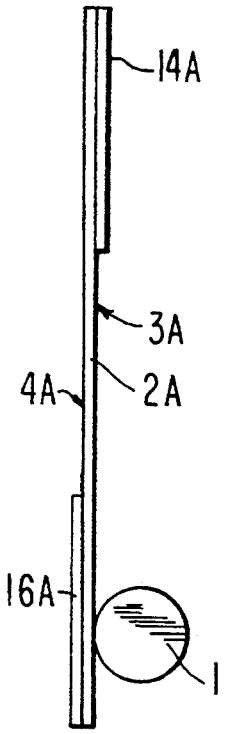
FIG. 4 is a side view, taken along the lines IV—IV, of FIG. 3.
Figure 5:
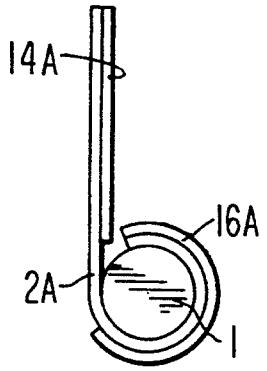
FIG. 5 is the view of FIG. 4, showing an intermediate stage in which the article to be carried and supported is partially rolled up in the sheet of the carrying device of the invention.

In use, the sheet 2A is placed on an attache case, or the like, by positioning it so that the handle, or handles, 10 of said case pass through the slit 9A whereby said sheet is mounted on said case. The sheet 2A rests against one of the sides of the attache case, briefcase, suitcase, or the like, and the user places the umbrella 1, or the like, on said sheet on the face 3A in proximity with the second edge 6A (FIGS. 3 and 4). The user then rolls the umbrella 1, or the like, up in the sheet 2A, as shown in FIGS. 5 and 6. When the umbrella 1 rolled up in its sheet 2A is just beneath the handles 10 of the case, the first and third strips of pressure fastening material 13A and 15A, respectively, are pressed into fastening engagement with each other and the second and fourth strips of pressure fastening material 14A and 16A, respectively, are pressed into fastening engagement with each other.

In the embodiment of FIGS. 1 to 6, the first and second strips of pressure fastening material 13A and 14A are divided by slits 18A and 19A, respectively (FIGS. 1 and 3). This enables the strips 13A and 14A to have a relatively small dimension along the third and fourth edges 7A and 8A. If the strips 13A and 14A are made long enough in their third and fourth edge dimensions, the slits 18A and 19A may be unnecessary.

Figure 7:
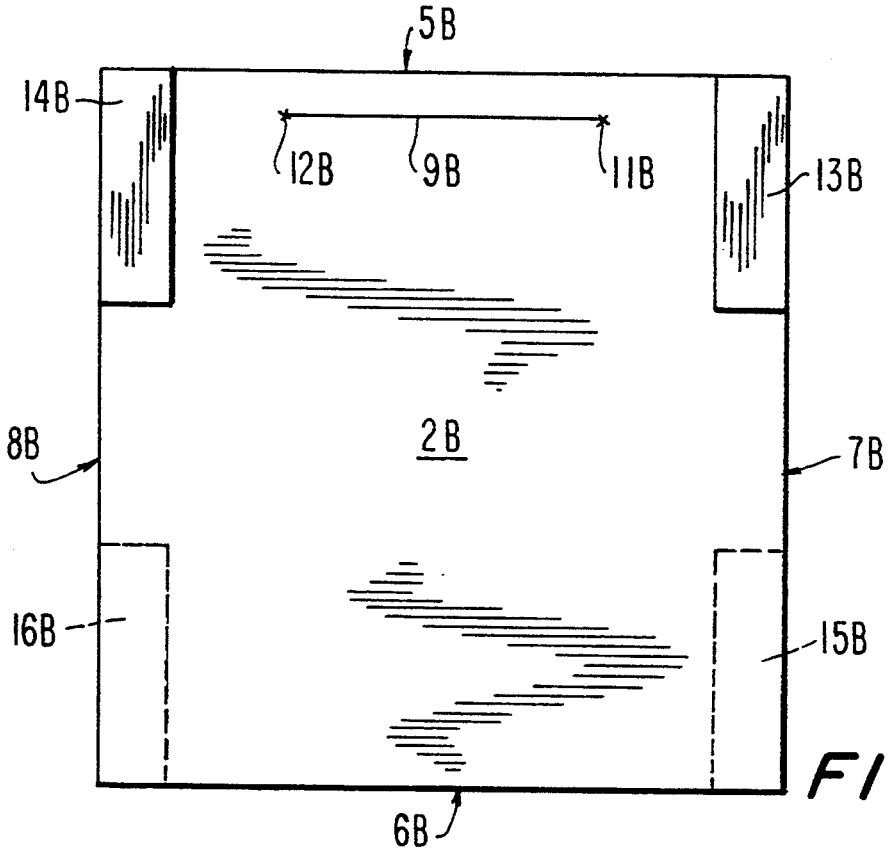
FIG. 7 is a top plan of a second embodiment of the carrying device of the invention.

When the umbrella 1 rolled up in its sheet 2A is just beneath the handles 10 of the case, the portions of the first and second strips of pressure fastening material 13A and 14A, respectively, of the embodiment of FIGS. 1 to 6 bordering the third and fourth edges 7A and 8A are folded and pressed into fastening contact with the third and fourth strips of pressure fastening material 15A and 16A, respectively. If the second embodiment of FIG. 7 is used, in which there are no slits 18A and 19A, the first and third strips of fastening material 13A and 15A, respectively, and the second and fourth strips of fastening material 14A and 16A, respectively, are pressed into fastening contact with each other. The umbrella 1, or the like, is thereby secured in a stable, neat, essentially cylindrical package, which package is securely mounted on the attache case, or the like.

The umbrella 1, or the like, is unpacked for use with ease, facility, convenience and rapidity and may be accomplished by the user with the use of one hand. The first and second strips of pressure fastening material 13A and 14A, respectively, are unfastened by pulling the rolled sheet 2A so that the third and fourth strips of pressure fastening material 15A and 16A, respectively, are separated from said first and second strips, respectively. The sheet 2A is then unrolled and the umbrella 1, or the like, is freed for use. The unfurled sheet 2A may then be folded and stored where ever desired, or it may be left hanging, rolled and secured as aforedescribed, or as a sheet, from the handle or handles 10. Small dimensioned sheets 2A may fit inside an attache case, briefcase, or the like, without folding and will occupy a negligibly small volume of the interior of such case, or the like.

The carrying device of the invention does not interfere with the use of the attache case, briefcase, suitcase, or the like, and is usable with any sized handle widths and/or lengths. The vinyl material of the sheet 2A is sufficiently rigid to prevent sagging. If more flexible material is used as the sheet 2A it may be stiffened as desired by any suitable means such as, for example, by bonding relatively rigid material to said sheet in desired areas of said sheet. The carrying device of the invention inherently conforms in shape to the umbrella 1, or the like, and is adjustable and adaptable to all different sizes and shapes of objects to be supported and carried. The device is portable, so it does not have to be used, unless desired, and it can be stored with ease, facility and rapidity in the attache case, or the like, or where ever desired, when not in use.

The supported and carried umbrella 1, or the like, is ready for use in an instant, when desired. When the umbrella 1, or the like, is wet it is supported and carded in an instant with great convenience and without interference with, or wetting of, the contents of the attache case, or the like.

The carrying device of the invention may be readily modified to support and carry any suitable articles, or objects, as hereinbefore mentioned. Furthermore, if the carrying device of the invention is to be used in other circumstances than mounted on an attache case, or the like, the slit, or slot, 9A may be replaced by different support means for mounting on walls, doors, or other rigid surfaces, flexible and inflexible containers of any kind, bicycles, motor vehicles, or where ever desired. Thus, elongated objects such as long strips of wood or aluminum, for example, may be carded and supported by two carrying devices of the invention, each mounted on a different outer door handle on the same side of an automotive vehicle. The elongated objects are wrapped in both carrying devices of the invention, which are then supported on the door handles. In this manner, the elongated objects may be carded and stored without protruding from open windows, or the open trunk of the vehicle, so that said objects are transported with facility, convenience and safety. Furthermore, the carrying device of the invention may be affixed to an attache case, briefcase, suitcase, or the like, on the inside or outside by any suitable means. Also, if an attache case, briefcase, suitcase, or the like, has two handles, one carrying device of the invention may be mounted via one handle and another carrying device of the invention may be mounted via the other handle. Even if there is only one handle, two carrying devices of the invention may be hung from said handle, each hanging on a different side.

Figure 8:
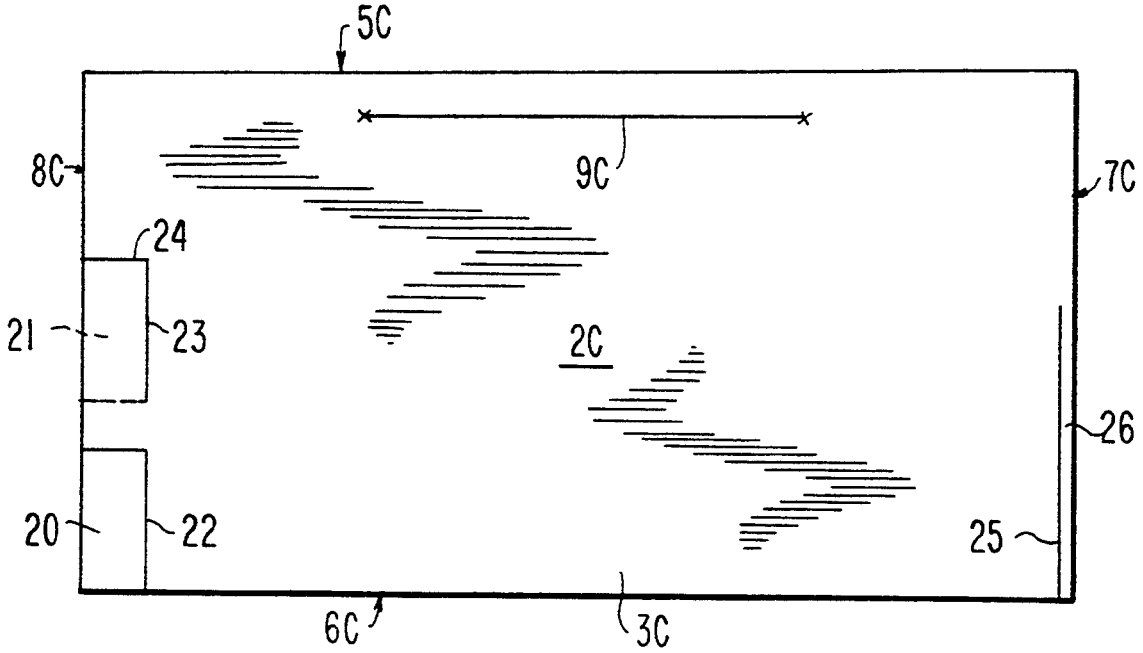
FIG. 8 is a top plan of a third embodiment of the carrying device of the invention.

The carrying device of the invention may thus be used to carry and support a tennis racket. FIG. 8 illustrates a view of a third embodiment of the invention for carrying and supporting a tennis racket. In the third embodiment of FIG. 8, the sheet 2C has a slit, or slot, 9C, or the like, formed therethrough in proximity with the first edge 5C and preferably substantially parallel to said first edge. A fastener 20 is provided on one face 3C of the sheet 2C adjacent the second and fourth edges 6C and 8C, respectively, as shown in FIG. 8 by solid lines. A fastener 21 is provided on the other face (not shown in FIG. 8) of the sheet 2C adjacent the fourth edge 8C and spaced from the first edge 5C and the fastener 20. A slit 22 is formed through the sheet 2 along one dimension of the fastener 20 and slits 23 and 24 are formed through the sheet 2C along two dimensions of the fastener 21. A slit 25 is formed through the sheet 2C in close proximity with the third edge 7C and preferably substantially parallel to said third edge thereby forming a thin strip 26.

The third embodiment, shown in FIG. 8, may be specifically utilized to carry and support an object having a handle and a broad head extending from one end of the handle, such as a tennis racket. The handle of the racket is wrapped in the fastener strip 20 and then the fastener strip 21 is wrapped over the fastener strip 20 and releasably affixed thereto, after the racket is placed on the face 3C of the sheet 2C. Then, the strip 26 is extended through the head of the racket in interweaving fashion to releasably secure said head to said sheet.

Figure 9:
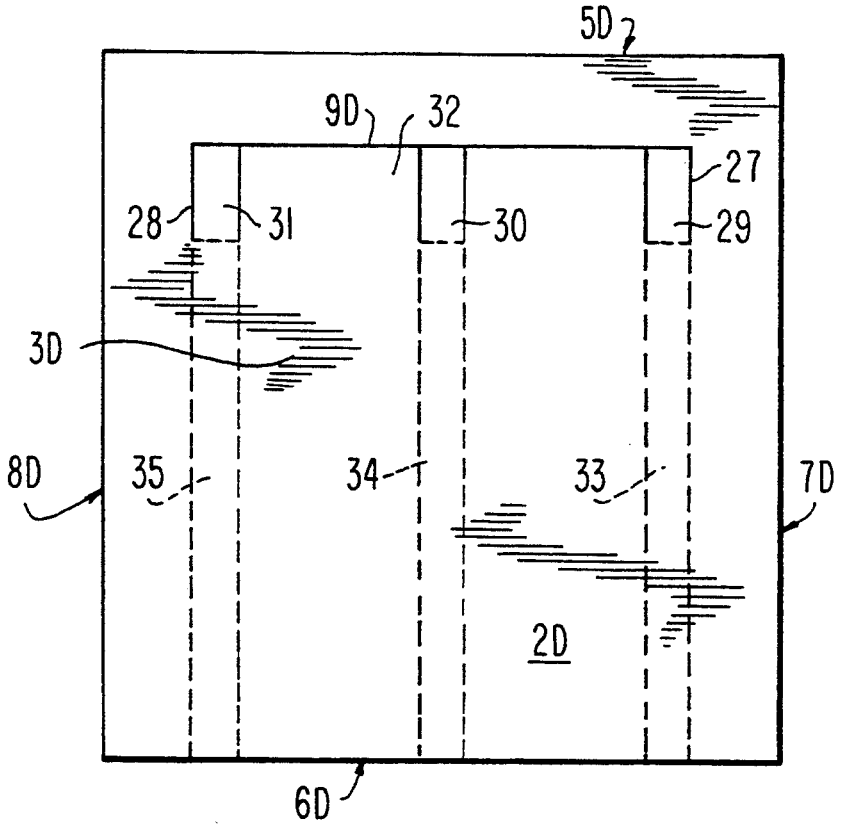
FIG. 9 is a top plan of a fourth embodiment of the carrying device of the invention.

FIG. 9 illustrates a fourth embodiment of the invention for carrying and supporting an object, or object, on a container having a broad handle, or handles, or support means such as, for example, a lunch pail. In the fourth embodiment of FIG. 9, the sheet 2D has a slit, or slot, 9D, or the like, formed therethrough in proximity with the first edge 5D and preferably substantially parallel to said first edge. Slits 27 and 28 are formed through the sheet 2D at the opposite ends of the slit 9D and preferably substantially parallel to the third and fourth edges 7D and 8D, respectively, and in proximity with said third and fourth edges, respectively. A plurality of spaced fastener strips 29, 30 and 31 are provided on the face 3D of the flap 32 formed by the slits 9D, 27 and 28 in substantially parallel relation with the third and fourth edges 7D and 8D. A matching plurality of spaced fastener strips 33, 34 and 35 are provided on the other face (not shown in FIG. 9) of the sheet 2 in substantially linear relation with the fastener strips 29, 30 and 31 and extending from at, or close to, the second edge 6D to at, or close to, the corresponding fastener strips 29, 30 and 31.

Thus, after an article, articles, object, or objects, is, or are, placed on the face 3D of the sheet 2D and rolled up in said sheet from the second edge 6D, the package so formed may be releasably secured by bringing the flap 32 down with the fastener strips 29, 30 and 31 of said flap into fastening contact with the corresponding fastener strips 33, 34 and 35 wrapped around the object, or objects. The moving of the flap 32 opens a large slot or aperture through the sheet 2D for accommodating a broad handle, or handles, or the like, of a container.

Figure 10:
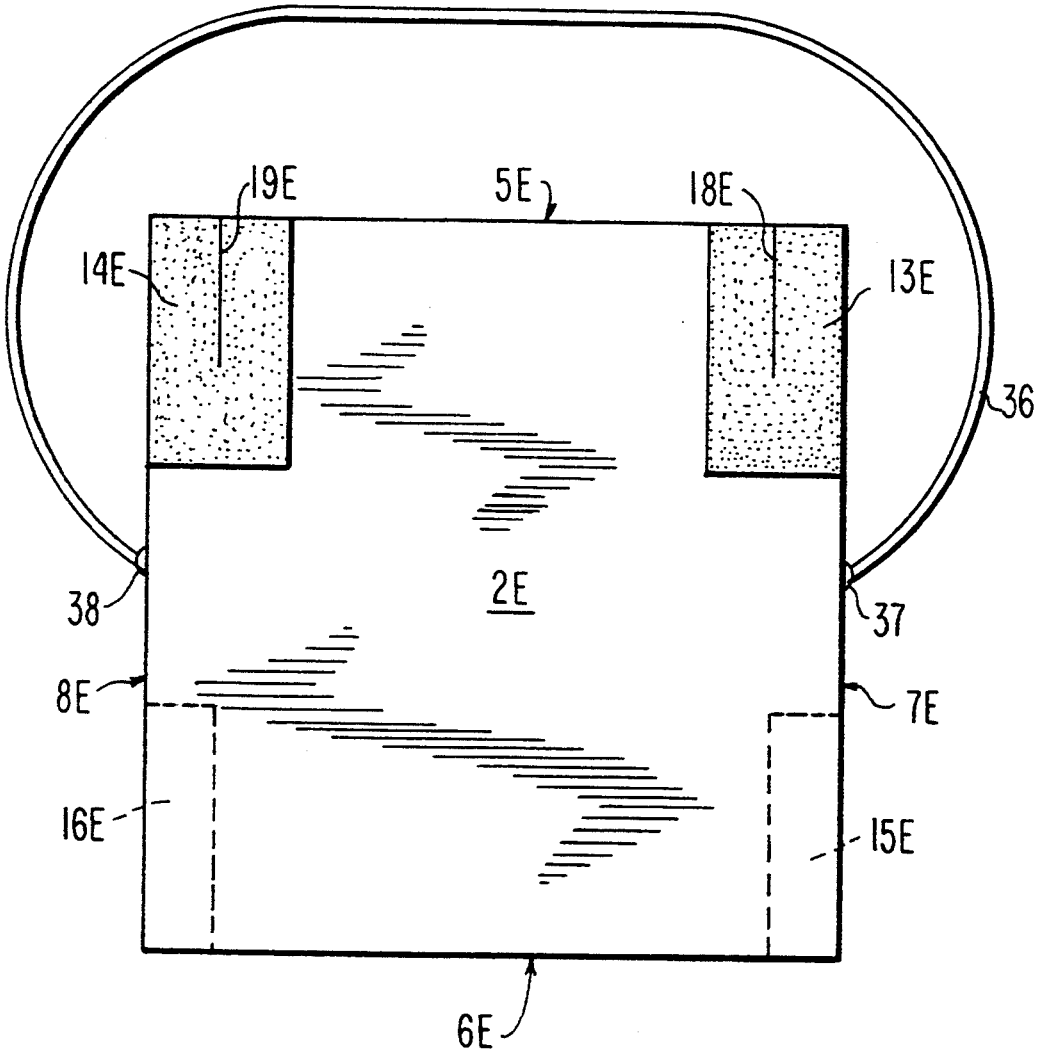
FIG. 10 is a top plan of a fifth embodiment of the carrying device of the invention.

FIG. 10 shows a fifth embodiment of the invention for carrying and supporting an object, or objects. The fifth embodiment is the same as the first embodiment of FIGS. 1 to 6, with the exception that in the fifth embodiment of FIG. 10, the slit 9A of the first embodiment of FIG. 1 is replaced by a cord 36 of any suitable material affixed at its ends 37 anti 38 to the third and fourth edges 7E and 8E, respectively, of the sheet 2E. The cord, or cord-like material, 36, is then used to hang the carrying device of the invention on any support means such as, for example, a handle, or handles, or an attache case, briefcase, or any type of manual carrier device. The opposite ends of the cord, or cord-like material, 36, may, alternatively, be connected to opposite ends of an umbrella carried in the carrying device of the invention for objects.

Figure 11:
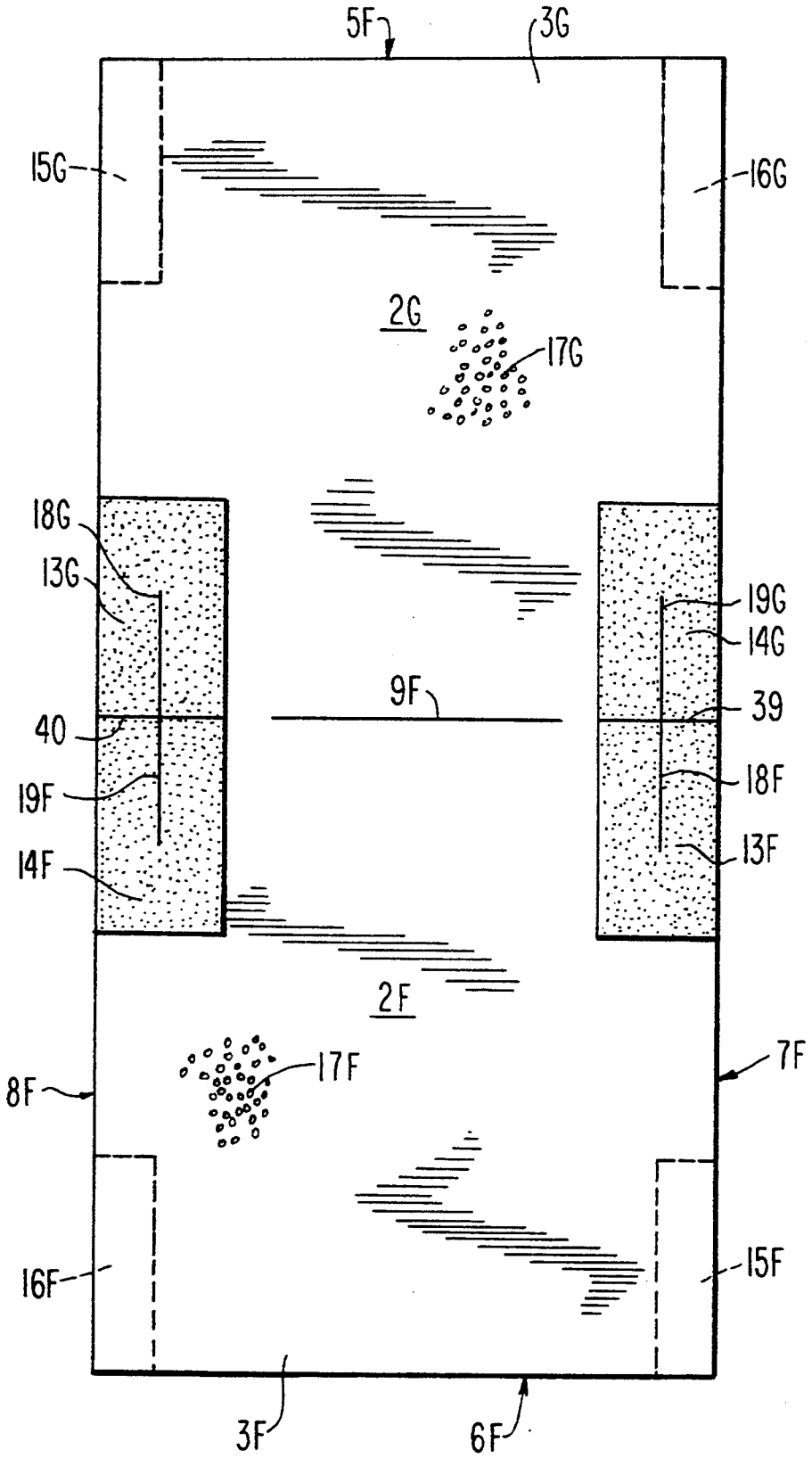
FIG. 11 is a top plan of a sixth embodiment of the carrying device of the invention.

FIG. 11 illustrates a sixth embodiment of the invention for carrying and supporting an object, or objects. The sixth embodiment of FIG. 11 is the first embodiment of FIGS. 1 to 6 provided in duplicate, edge-to-edge, symmetrical relation. The sheet 2F, 2G is twice as long in the embodiment of FIG. 11 as it is in the embodiment of FIG. 1 and the slit, or slot, 9F, or the like, is formed through part of the dividing line between the halves 2F and 2G of said sheet. Second and third slits, or slots 39 and 40, or the like, are also formed through pans of the dividing line and spaced from the slit 9F, but extending to the edges 7F and 8F, respectively. The fasteners 13A, 14A, 15A and 16A of the first embodiment are identified as 13F, 14F, 15F and 16F in half of the sixth embodiment and the fasteners of the other half of said sixth embodiment are identified as 13G, 14G, 15G and 16G. The slits 18A and 19A of the first embodiment are identified as 18F and 19F in half of the sixth embodiment and these slits of the other half of said sixth embodiment are identified as 18G and 19G.

Each half of the sixth embodiment of FIG. 11 is used in the same manner as the first embodiment of FIG. 1, except that two articles, or objects, or groups of objects, may be wrapped. The carrying device, when wrapped is mounted on a handle, or handles, or other support means, 10, via its slit 9F whereby said carrying device functions as a "pack saddle."

Although shown and described in what is believed to be the most practical and preferred embodiment, it is apparent that departures from the specific method and design described and shown will suggest themselves to those skilled in the art and may be made without departing from the spirit and scope of the invention. I, therefore, do not wish to restrict myself to the particular construction described and illustrated, but desire to avail myself of all modifications that may fall within the scope of the appended claims.

I claim:

1. A carrying device for an elongated article, said device comprising a sheet of substantially flexible material having a pair of spaced opposite faces, first and second spaced opposite side edges and third and fourth spaced opposite side edges, said side edges bordering said opposite faces;

a first slit formed through said sheet in proximity with said first edge for removably supporting said sheet on a supporting object;

fastening means on one of said faces of said sheet adjacent said first edge and each of said third and fourth edges and on the other of said faces of said sheet adjacent said second edge and each of said third and fourth edges for fastening said sheet to itself with an article rolled up therein and with said second edge in proximity with said first edge whereby said sheet supports and carries said article so that said article is removably supported and carried by said supporting object via said sheet, said fastening means comprising a first strip of pressure fastening material on one of said faces of said sheet extending along said third edge from said first edge, a second strip of pressure fastening material on said one of said faces of said sheet extending along said fourth edge from said first edge, a third strip of pressure fastening material on the other of said faces of said sheet extending along said third edge from said second edge and a fourth strip of pressure fastening material on said other of said faces of said sheet extending along said fourth edge from said second edge, said first and third strips being releasably affixed to each other when said article is rolled up in said sheet and at least part of said first and third strips overlap and are pressed together and said second and fourth strips being releasably affixed to each other when said article is rolled up in said sheet and at least part of said second and fourth strips overlap and are pressed together; and a second slit in said sheet through said first strip of pressure fastening material spaced from and substantially parallel to said third edge and a third slit in said sheet through said second strip of pressure fastening material spaced from and substantially parallel to said fourth edge.

* * * * *